US006644253B2

(12) United States Patent
Haskara et al.

(10) Patent No.: US 6,644,253 B2
(45) Date of Patent: Nov. 11, 2003

(54) METHOD OF CONTROLLING AN ELECTROMAGNETIC VALVE ACTUATOR

(75) Inventors: Ibrahim Haskara, Brownstown, MI (US); Lawrence Mianzo, Plymouth, MI (US); Vladimir Kokotovic, Bloomfield Hills, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/109,350

(22) Filed: Mar. 28, 2002

(65) Prior Publication Data

US 2003/0106511 A1 Jun. 12, 2003

Related U.S. Application Data

(60) Provisional application No. 60/339,418, filed on Dec. 11, 2001.

(51) Int. Cl.[7] ..... F01L 9/04
(52) U.S. Cl. ..... 123/90.11; 251/129.01
(58) Field of Search ..... 123/90.11; 251/129.01, 251/129.15, 129.16, 129.09, 129.1

(56) References Cited

U.S. PATENT DOCUMENTS

| | | | | | |
|---|---|---|---|---|---|
| 4,515,343 | A | | 5/1985 | Pischinger et al. | |
| 4,777,915 | A | | 10/1988 | Bonvalletq | |
| 4,794,890 | A | * | 1/1989 | Richeson, Jr. | 123/90.11 |
| 5,076,221 | A | * | 12/1991 | Kawamura | 123/90.11 |
| 5,592,905 | A | | 1/1997 | Born | |
| 5,671,705 | A | * | 9/1997 | Matsumoto et al. | 123/90.11 |
| 5,791,305 | A | | 8/1998 | Kather et al. | |
| 5,799,630 | A | * | 9/1998 | Moriya et al. | 123/90.11 |
| 5,832,883 | A | | 11/1998 | Bae | 123/90.11 |
| 5,868,108 | A | * | 2/1999 | Schmitz et al. | 123/90.11 |
| 5,917,692 | A | | 6/1999 | Schmitz et al. | |
| 6,003,481 | A | | 12/1999 | Pischinger et al. | |
| 6,047,673 | A | | 4/2000 | Lohse et al. | |
| 6,066,999 | A | | 5/2000 | Pischinger | |
| 6,073,651 | A | | 6/2000 | Conrads et al. | |
| 6,101,992 | A | | 8/2000 | Pischinger et al. | |
| 6,176,207 | B1 | * | 1/2001 | Wright et al. | 123/90.11 |
| 6,176,208 | B1 | | 1/2001 | Tsuzuki et al. | 123/90.11 |
| 6,196,172 | B1 | * | 3/2001 | Cosfeld et al. | 123/90.11 |

(List continued on next page.)

FOREIGN PATENT DOCUMENTS

| | | |
|---|---|---|
| DE | 19836562 | 3/2000 |
| DE | 19960796 | 9/2000 |
| EP | 0281192 | 9/1988 |
| EP | 0870906 | 3/1998 |
| EP | 1255026 | 3/2002 |
| JP | 7305612 | 11/1995 |
| JP | 11229833 | 8/1999 |

OTHER PUBLICATIONS

WO 00/71861 A1, PCT/EP00/04463, Schmitz et al., Method For Controlling An Electromagnetic Valve Drive Mechanism For A Gas Exchange Valve In An Internal Combustion Piston Engine, Nov. 30, 2000.

*Primary Examiner*—Thomas Denion
*Assistant Examiner*—Ching Chang
(74) *Attorney, Agent, or Firm*—Brinks Hofer Gilson & Lione

(57) ABSTRACT

Four preferred methods are disclosed for controlling an electromagnetic valve actuator having a valve head that moves between an open position and a closed position against a valve seat, an armature coupled to the valve head, and a solenoid coil near the armature. The preferred methods include: measuring the position of the armature, estimating the speed of the armature based on the measured position of the armature, computing a desired signal based on the measured position, the estimated speed, and a reference trajectory, and controlling the solenoid coil to softly seat the armature against the solenoid coil and the valve head against the valve seat based on the computed desired signal.

6 Claims, 6 Drawing Sheets

U.S. PATENT DOCUMENTS 6,260,521 B1 * 7/2001 Kirschbaum ..... 123/90.11
6,321,700 B1 * 11/2001 Hein et al. ..... 123/90.11
6,349,685 B1 * 2/2002 Kolmanovsky et al. .. 123/90.11
6,359,435 B1 * 3/2002 Czimmek et al. ..... 324/234
6,397,797 B1 * 6/2002 Kolmanovsky et al. .. 123/90.11
6,418,003 B1 * 7/2002 Xiang ..... 361/172
6,427,651 B1 * 8/2002 Kemper et al. ..... 123/90.11
6,427,971 B1 8/2002 Kawabe et al. ..... 251/129.04
6,474,276 B1 * 11/2002 Schmitz et al. ..... 123/90.11
6,476,599 B1 * 11/2002 Czimmek et al. ..... 324/207.16

* cited by examiner

METHOD OF CONTROLLING AN ELECTROMAGNETIC VALVE ACTUATOR

CROSS-REFERENCE TO RELATED APPLICATIONS

The present invention claims priority to U.S. Provisional Application Serial No. 60/339,418 entitled "High-bandwidth (sensorless) soft seating control of an electromagnetic valve actuator system", filed Dec. 11, 2001, and incorporated in its entirety by this reference.

TECHNICAL FIELD

This invention relates generally to the valve actuation field and, more specifically, to an improved method of controlling an electromagnetic valve actuator for an engine of a vehicle.

BACKGROUND

In a conventional engine of a typical vehicle, a valve is actuated from a closed position against a valve seat to an open position at a distance from the valve seat to selectively pass a fluid, such as a fuel and air mixture, into or out of a combustion chamber. Over the years, several advancements in valve actuations, such as variable valve timing, have improved power output, fuel efficiency, and exhaust emissions. Variable valve timing is the method of actively adjusting either the duration of the close or open cycle, or the timing of the close or open cycle of the valve. Several automotive manufacturers, including Honda and Ferrari, currently use mechanical devices to provide variable valve timing in their engines.

A more recent development in the field of variable valve timing is the use of two solenoid coils located on either side of an armature to open and close the valve heads. Activation of one of the solenoid coils creates an electromagnetic pull on the armature, which moves the valve in one direction. Activation of the other solenoid coil creates an electromagnetic pull on the armature, which moves the valve in the other direction. This system, also known as electromagnetic valve actuator (or "EMVA"), allows for an infinite variability for the duration and timing of the open and close cycles, which promises even further improvements in power output, fuel efficiency, and exhaust emissions.

In an engine, it is desirable to swiftly move the valve between the open position and the closed position and to "softly seat" the valve against the valve seat. The force created by the EMVA, which is related to the distance between the solenoid coil and the armature, increases non-linearly as the armature approaches the solenoid coil. In fact, the solenoid coil can forcefully slam the armature against the solenoid coil, which may also forcefully slam the valve head into the valve seat. The slamming of the valve against the valve seat, or the slamming of the armature against the solenoid coils, causes undesirable noise, vibration, and harshness ("NVH") within the vehicle. Thus, there is a need in the automotive industry to create an EMVA with soft seating capabilities.

DESCRIPTION OF THE PREFERRED EMBODIMENTS

The following description of the four preferred methods of the invention is not intended to limit the invention to these preferred methods, but rather to enable a person skilled in the art to make and use this invention.

Figure 1A:
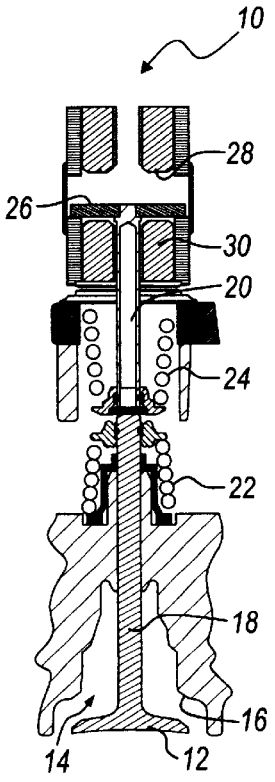
FIGS. 1A, 1B, and 1C are cross-sectional views of an electromagnetic valve actuator used in the preferred methods.
Figure 1B:
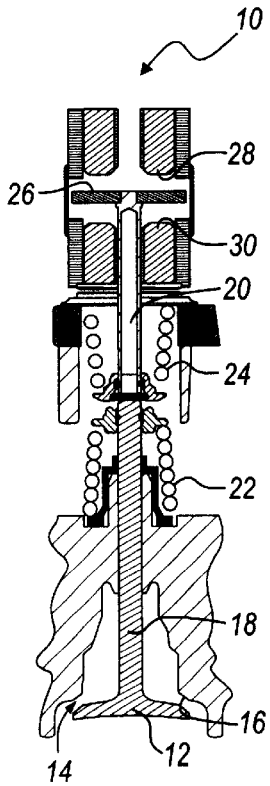
Figure 1C:
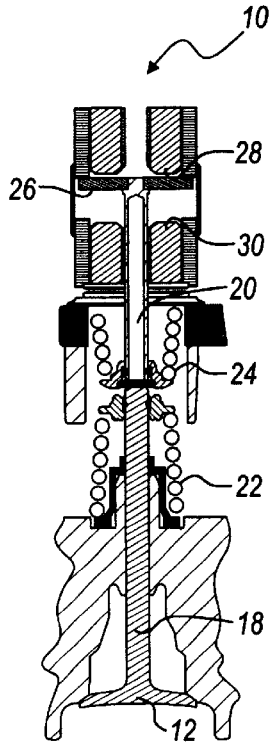

As shown in FIGS. 1A, 1B, and 1C, the preferred methods of the invention can be used to control an electromagnetic valve actuator 10 ("EMVA") of an engine of a vehicle. The preferred methods may also be used to control an EMVA 10 of other suitable devices, such as in an engine of a watercraft or aircraft or in other fluid actuating systems.

The EMVA 10 used in the preferred methods includes a valve head 12 that moves between an open position (shown in FIG. 1A) and a closed position (shown in FIG. 1C). The valve head 12 functions to selectively pass fluid through an orifice 14 by moving from a closed position to an open position. Preferably, the valve head 12 selectively moves a distance from the orifice 14, which allows the passage of a fuel and air mixture into a combustion chamber of an engine (only partially shown), and then moves against a valve seat 16 around the orifice 14 to block the passage of the fuel and air mixture.

The EMVA 10 used in the preferred methods also includes a valve stem 18, an armature stem 20, a first spring 22, and a second spring 24. The valve stem 18 functions to actuate the valve head 12 form a location remote from the orifice 14. The armature stem 20, the first spring 22, and the second spring 24 collectively cooperate with the valve stem 18 to substantially negate the effects of temperature changes on the EMVA 10. The first spring 22 biases the valve stem 18 toward the armature stem 20, while the second spring 24 biases the second valve stem toward the valve stem 18. In this manner, the valve stem 18 and the armature stem 20 substantially act as one unit during the movement of the valve head 12, but allow for the elongation of the valve stem 18 caused by temperature fluctuations within the engine. In addition to providing forces to bias the valve stem 18 and the armature stem 20 together, the first spring 22 and the second spring 24 are preferably designed to bias the valve head 12 into an equilibrium position or "middle position" (shown in FIG. 1B) between the open position and the closed position.

The EMVA 10 used in the preferred methods also includes an armature 26 coupled to the valve head 12 through the armature stem 20 and the valve stem 18, a first solenoid coil 28 located on one side of the armature 26, and a second solenoid coil 30 located on the other side of the armature 26. Preferably, the armature 26 extends from the armature stem 20 with a rectangular, cylindrical, or other appropriate shape and includes a magnetizable and relatively strong material, such as steel. The first solenoid coil 28 functions to create an electromagnetic force on the armature 26 to move the valve head 12 into the closed position, while the second solenoid coil 30 functions to create an electromagnetic force on the armature 26 to move the valve head 12 into the open position.

Figure 2:
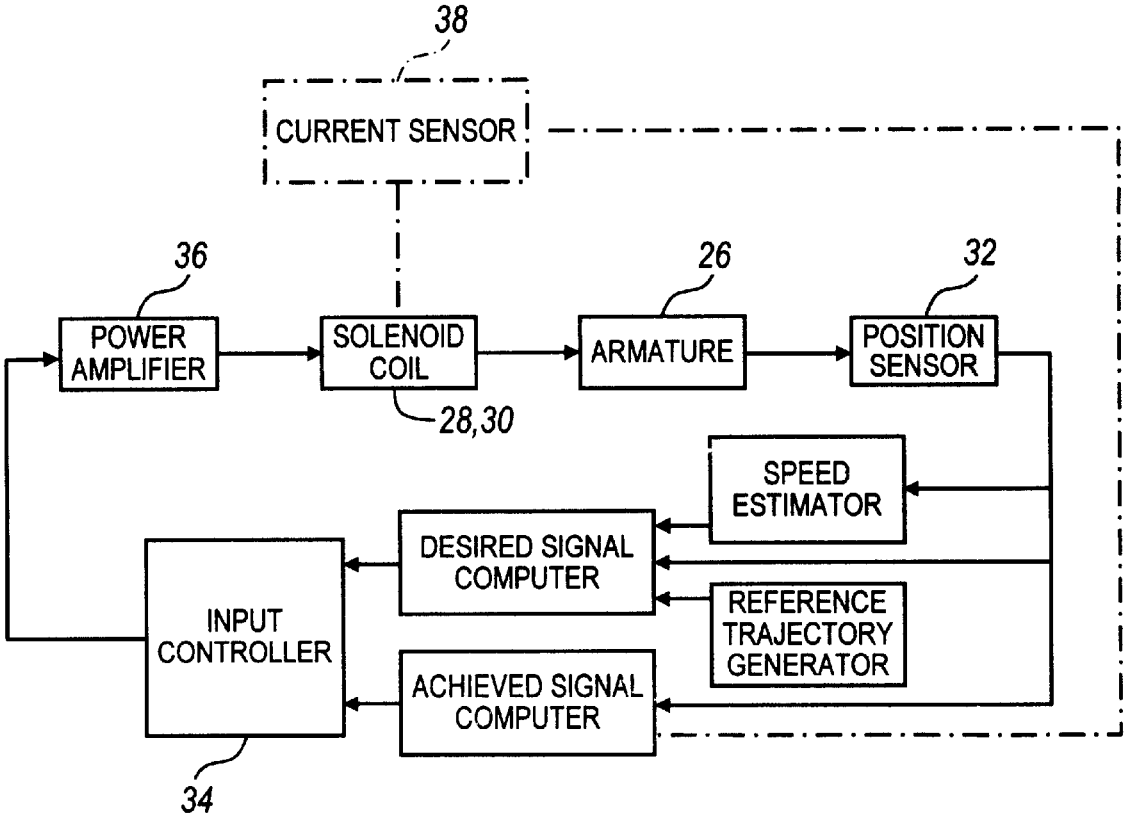
FIG. 2 is a schematic of the electromagnetic valve actuator of FIGS. 1A, 1B, and 1C.

As shown in FIG. 2, the EMVA used in the preferred methods also includes a position sensor 32 for the armature 26. The position sensor 32 preferably functions to create a position signal based upon the location of the armature 26, but may alternatively function to create a signal based upon the location of the valve head or any other suitable element in the EMVA. The position sensor 32 is preferably a differential variable reluctance transducer, but may alternatively be any suitable position sensor.

The EMVA used in the preferred methods also includes an input controller 34, which functions to alternatively activate the solenoid coils to move the valve head from open position, through the middle position, and into the closed position and to move the valve head from the closed position, through the middle position, and into the open position. The input controller 34 preferably allows for the continuous operation of the valve head with a cycle time of about 3 milliseconds, depending on the spring constants, the distance of armature travel, and the mass of the elements, amongst other factors.

The EMVA used in the preferred methods also includes a switching power amplifier 36, which functions to quickly and accurately adjust the voltage applied to the solenoid coil 28, 30. The switching power amplifier 36 preferably includes a single rail (not shown) with a voltage that may be added to increase the voltage or subtracted to decrease the voltage to the solenoid coil 28, 30. The switching power amplifier 36 may alternatively include two rails, with a larger rail for rapid changes and a smaller rail for low frequency tracking. The EMVA may, however, include other suitable devices to accomplish the quick and accurate adjustment of the voltage applied to the solenoid coil.

As shown in FIGS. 3–6, the preferred methods for controlling the EMVA include: measuring the position of the armature, estimating the speed of the armature based on the measured position of the armature, computing a desired signal based on the measured position, the estimated speed, and a reference trajectory, and controlling the solenoid coil to softly seat the armature against the solenoid coil and the valve head against the valve seat based on the computed desired signal. The preferred methods may further include other acts as described below or as envisioned by a skilled person in the art. "Soft seating" is defined as a speed for the armature and the valve head to seat against the respective solenoid coil and the valve seat with acceptable NVH and durability. In some circumstances, the "soft seating" will be a speed equal to or less than about 0.1 meters per second.

The act of estimating the speed of the armature based on the measured position of the armature is preferably accomplished with the following equation:

$$y_{est} = \frac{d\hat{x}}{dt} = \mathrm{sign}_{app}(L_1, x - \hat{x})$$

where $y_{est}$ is the estimated speed of the armature, x is the measured position of the armature, $\hat{x}$ is the state variable for the speed estimator, $\mathrm{sign}_{app}(.,.)$ is a smooth approximation for the sign function, which has a high slope around the zero value of its second argument and is saturated to +/− value of its first argument, and $L_1$ is a maximum value for the speed of the armature. The act of estimating the speed of the armature may alternatively be accomplished with other suitable equations or models.

The act of computing a desired signal for the solenoid coil is preferably accomplished with the following equation:

$$F_{des} = M\frac{d^2 r}{dt^2} + B\frac{dx}{dt} + Kx - g_1(x - r) - g_2\left(\frac{dx}{dt} - \frac{dr}{dt}\right)$$

where $F_{des}$ is the desired force for the solenoid coil, M is the movable mass (including the armature, the valve stem, the armature stem, and the valve head), B is the viscous damping, K is the spring constant, $g_1$ and $g_2$ are feed-forward parameters—possibly in the form of nonlinear functions—based on an expected load force on the engine and the EMVA, and r is a reference trajectory for the armature to softly seat the armature against the solenoid coil based on the following equation:

$$\overline{M}\frac{d^2 r}{dt} + \overline{B}\left(r, \frac{dr}{dt}\right) + \overline{K}(r) = \overline{F}$$

The act of computing a desired force for the solenoid coil may alternatively be accomplished with other suitable equations and models, which may or may not include a feed-forward parameter. Similarly, the reference trajectory may alternatively be accomplished with other suitable equations and models.

Figure 3:
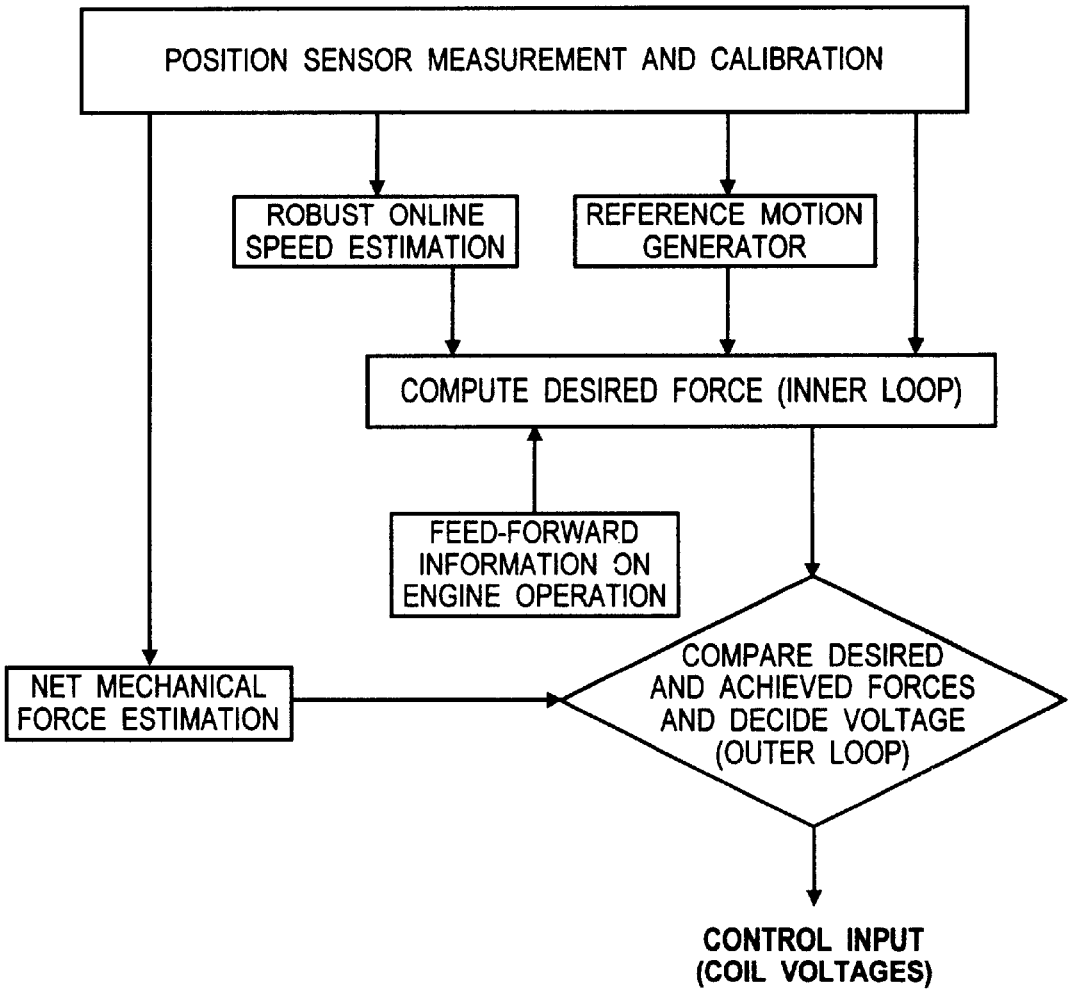
FIGS. 3, 4, 5, and 6 are flowcharts of the four preferred methods of the invention.

As shown in FIG. 3, the first preferred method further includes: estimating an achieved mechanical force for the armature based on the measured position of the armature, and controlling the solenoid coil based on the computed desired force and the estimated achieved mechanical force.

The act of estimating the achieved mechanical force for the armature is preferably accomplished with the following equations:

$$z_{est} = \frac{d\hat{y}}{dt} = \mathrm{sign}_{app}(L_2, y_{est} - \hat{y})$$

where $z_{est}$ is the acceleration estimate, $\hat{y}$ is the state variable for the acceleration estimator, and $L_2$ is a maximum value for the acceleration of the armature, and $$F_{est} = Mz_{est} + By_{est} + Kx$$

where $F_{est}$ is the estimated achieved force for the armature. The act of estimating the achieved force for the armature may, of course, be accomplished with other suitable equations and models.

Figure 4:
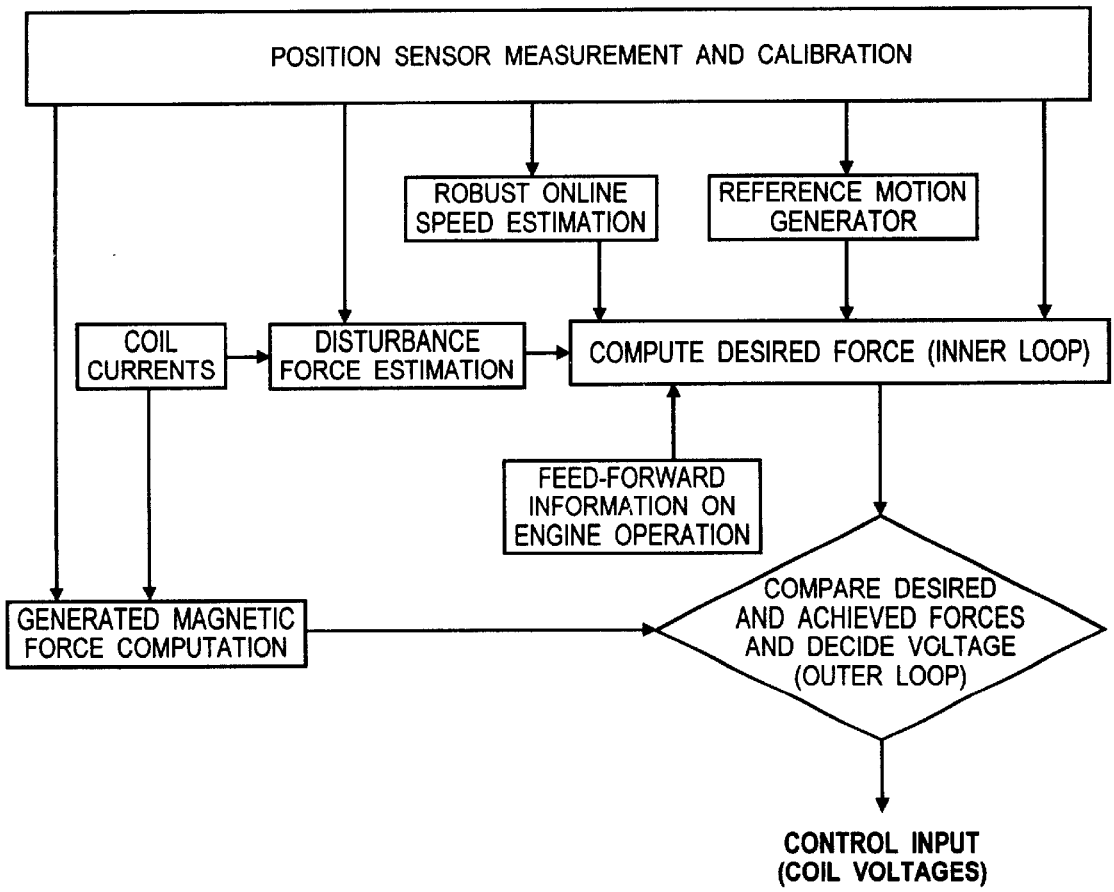

As shown in FIG. 4, the second preferred method, which is similar to the first preferred method, includes measuring the current of the solenoid coil, estimating a generated magnetic force for the armature based on the measured position of the armature and the measured current of the solenoid coil (instead of estimating the achieved mechanical force), and estimating a disturbance force based on the measured position of the armature and the measured current of the solenoid coil. In this preferred method, the act of computing a desired force for the armature is further based on the estimated disturbance force and the act of controlling the solenoid coil is based on the computed desired force and the estimated generated magnetic force for the armature.

The act of measuring the actual current for the solenoid coil is preferably accomplished with a current sensor 38 (as shown in FIG. 2). The current sensor 38 preferably includes a resistor with a differential amplifier that outputs a voltage proportional to the current but may alternatively include any suitable device.

The act of estimating the electromagnetic force generated by the solenoid coil is preferably accomplished based upon the measured position and speed of the armature, the measured current for the solenoid coil, and experimental data used with the known relationships between the position and speed of the armature, the current in the solenoid coil, and the magnetic force. The act of estimating the electromagnetic force generated by the solenoid coil may, however, be accomplished with other suitable equations and models.

The act of estimating a disturbance force is preferably accomplished with the following equation:

$$M\frac{d^2x}{dt^2}+B\frac{dx}{dt}+Kx=f_m+\delta$$

where $f_m$ is the electromagnetic force generated by the solenoid coils and δ is the combination of the disturbance forces (including friction and engine load). The act of estimating the disturbance force may alternatively be accomplished with other suitable equation or models.

Figure 5:
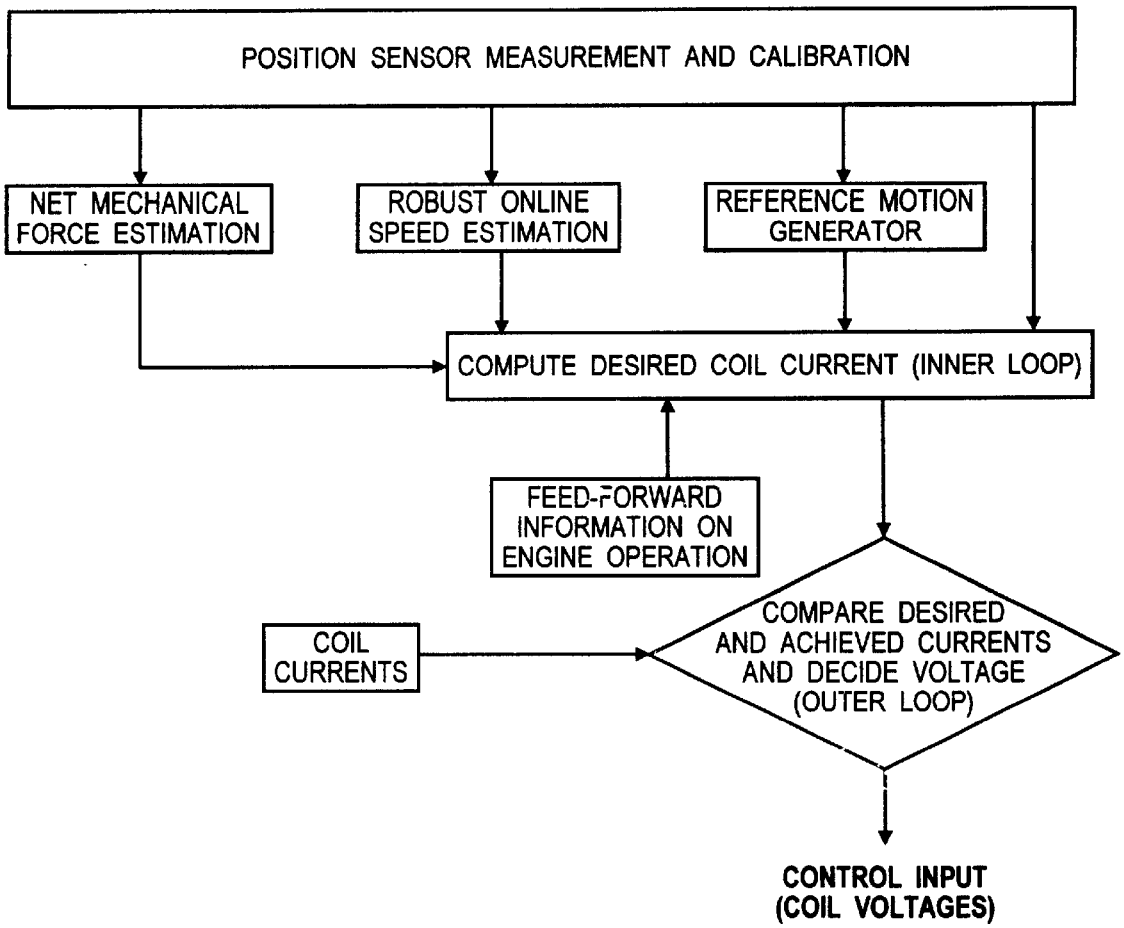

As shown in FIG. 5, the third preferred method includes estimating a mechanical force (similar to the first preferred method) and computing a desired current based on the position, speed, reference trajectory, and estimated mechanical force. The third preferred method also includes measuring the current of the solenoid coil (similar to the second preferred method). In this preferred method, the act of controlling the solenoid coil is based on the computed desired current and the measured current of the solenoid coil. Except for these differences, the third preferred method is similar to the first preferred method.

Figure 6:
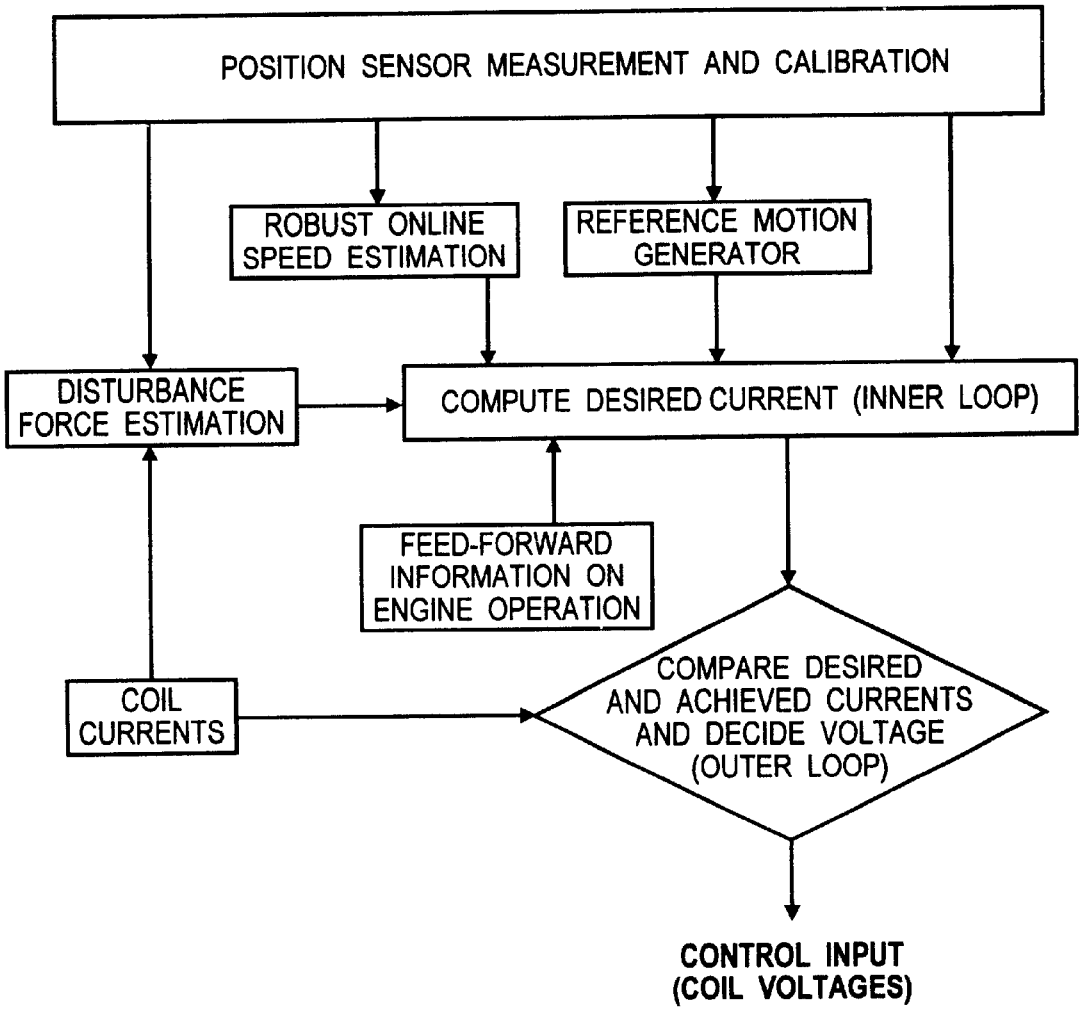

As shown in FIG. 6, the fourth preferred method is similar to the third preferred method. Instead of estimating a mechanical force for the armature, however, the fourth preferred method includes estimating a disturbance force (similar to the second preferred method). In this preferred method, the act of computing a desired current for the armature is based on the estimated disturbance force, not on an estimated achieved mechanical force.

Although the preferred methods of the invention have been described with respect to one solenoid coil, the preferred methods can be used with both the first solenoid coil and the second solenoid coil. Further, although the preferred methods of the invention have been described with respect to one EMVA (an intake valve), the preferred methods can be used on multiple EMVAs (both intake valves & exhaust valves) within an engine.

As a person skilled in the art will recognize from the previous detailed description and from the figures and claims, modifications and changes can be made to the preferred methods of the invention without departing from the scope of this invention defined in the following claims.

We claim:

1. A method of controlling an electromagnetic valve actuator having a valve head that moves between an open position and a closed position against a valve seat, an armature coupled to the valve head, and a solenoid coil near the armature, said method comprising:

measuring the position of the armature and the current of the solenoid coil;

estimating the speed of the armature based on the measured position of the armature;

estimating a disturbance force based on the measured position of the armature and the measured current of the solenoid coil;

computing a desired signal based on the measured position, the estimated speed, the disturbance force and a reference trajectory; and controlling the solenoid coil to softly seat the armature against the solenoid coil and the valve head against the valve seat based on the computed desired signal.

2. The method of claim 1 wherein said computing a desired signal includes computing a desired current for the solenoid coil; and wherein said controlling the solenoid coil is based on the computed desired current.

3. A method of controlling an electromagnetic valve actuator having a valve head that moves between an open position and a closed position against a valve seat, an armature coupled to the valve head, and a solenoid coil near the armature, said method comprising:

measuring the position of the armature and the current of the solenoid coil;

estimating the speed of the armature based on the measured position of the armature;

computing a desired signal based on the measured position, the estimated speed, the disturbance force and a reference trajectory;

estimating a generated magnetic force for the armature based on the measured position of the armature and the measured current of the solenoid coil; and controlling the solenoid coil to softly seat the armature against the solenoid coil and the valve head against the valve seat based on the computed desired signal and the estimated generated magnetic force.

4. The method of claim 3 further comprising estimating a disturbance force based on the measured position of the armature and the measured current of the solenoid coil; wherein said computing a desired force for the armature is further based on the estimated disturbance force.

5. The method of claim 4 further comprising generating the reference trajectory based on the measured position and the estimated speed.

6. The method of claim 5 wherein said computing a desired force is further based on a feed-forward parameter.

* * * * *